US008584744B2

(12) United States Patent
Soni et al.

(10) Patent No.: US 8,584,744 B2
(45) Date of Patent: Nov. 19, 2013

(54) DEBRIS CHAMBER WITH HELICAL FLOW PATH FOR ENHANCED SUBTERRANEAN DEBRIS REMOVAL

(75) Inventors: Mohan L. Soni, Katy, TX (US); Gerald D. Lynde, Houston, TX (US); Ronnie D. Russell, Cypress, TX (US); Jeremy J. Guillory, Katy, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 426 days.

(21) Appl. No.: 12/880,906

(22) Filed: Sep. 13, 2010

(65) Prior Publication Data

US 2012/0061073 A1 Mar. 15, 2012

(51) Int. Cl.
*E21B 33/08* (2006.01)
*E21B 27/04* (2006.01)

(52) U.S. Cl.
USPC ..... 166/99; 166/162; 166/311; 175/323

(58) Field of Classification Search
USPC ..... 166/99, 162, 311; 175/323
See application file for complete search history.

(56) References Cited

U.S. PATENT DOCUMENTS

| | | | | |
|---|---|---|---|---|
| 2,169,922 | A * | 8/1939 | Notley | 166/99 |
| 3,094,175 | A * | 6/1963 | Jackson | 175/69 |
| 3,895,930 | A * | 7/1975 | Campolong | 55/394 |
| 4,276,931 | A | 7/1981 | Murray | |
| 4,543,019 | A * | 9/1985 | Shikata | 408/57 |
| 4,857,175 | A * | 8/1989 | Spinnler | 209/235 |
| 4,924,940 | A | 5/1990 | Burroughs et al. | |
| 5,123,489 | A | 6/1992 | Davis et al. | |
| 5,139,095 | A * | 8/1992 | Lyon et al. | 175/68 |
| 5,295,537 | A * | 3/1994 | Trainer | 166/105.1 |
| 5,490,571 | A * | 2/1996 | Hanns et al. | 175/323 |
| 6,176,311 | B1 | 1/2001 | Ryan | |
| 6,189,617 | B1 | 2/2001 | Sorhus et al. | |
| 6,250,387 | B1 | 6/2001 | Carmichael et al. | |
| 6,276,452 | B1 | 8/2001 | Davis et al. | |
| 6,341,653 | B1 * | 1/2002 | Firmaniuk et al. | 166/311 |
| 6,607,031 | B2 | 8/2003 | Lynde et al. | |
| 6,695,058 | B1 * | 2/2004 | French | 166/312 |
| 6,978,841 | B2 | 12/2005 | Hoffman et al. | |

(Continued)

OTHER PUBLICATIONS

Connell, P., et al., "Removal of Debris from Deepwater Wellbores Using Vectored Annulus Cleaning System Reduces Problems and Saves Rig Time", SPE 96440, Oct. 2005, 1-6.

(Continued)

*Primary Examiner* — Jennifer H Gay
(74) *Attorney, Agent, or Firm* — Steve Rosenblatt

(57) ABSTRACT

A subterranean debris catcher swirls the incoming debris laden stream by putting grooves or spiral projections on the inside of the inlet pipe. The solids come out of openings in the side of the inlet pipe or the solids can exit near the top either directly into the enclosed solids holding volume as the liquid exits straight out or the solids can be discharged out the end of the inlet pipe into the bigger open space defined by the housing. In the latter case the inside housing wall can have a screen or vanes that slow down the solid particles as the fluid continues to a housing exit and eventually to an exit screen before being discharged to either go to the surface or recirculate back along the outside of the tool to the inlet pipe while picking up additional debris.

14 Claims, 5 Drawing Sheets

(56) References Cited

U.S. PATENT DOCUMENTS

| | | | | |
|---|---|---|---|---|
| 7,096,946 | B2 | 8/2006 | Jasser et al. | |
| RE39,292 | E * | 9/2006 | Latos et al. | 166/265 |
| 7,472,745 | B2 | 1/2009 | Lynde et al. | |
| 7,478,687 | B2 | 1/2009 | Lynde et al. | |
| 7,610,957 | B2 | 11/2009 | Davis et al. | |
| 7,635,430 | B2 | 12/2009 | Mildren et al. | |
| 7,779,901 | B2 | 8/2010 | Davis et al. | |
| 7,861,772 | B2 * | 1/2011 | Blair | 166/99 |
| 8,136,587 | B2 * | 3/2012 | Lynde et al. | 166/173 |
| 2009/0301710 | A1 | 12/2009 | Clem et al. | |
| 2010/0243258 | A1 * | 9/2010 | Fishbeck et al. | 166/311 |
| 2010/0258298 | A1 * | 10/2010 | Lynde et al. | 166/173 |
| 2010/0288485 | A1 * | 11/2010 | Blair | 166/99 |
| 2011/0024119 | A1 * | 2/2011 | Wolf et al. | 166/301 |
| 2012/0061073 | A1 * | 3/2012 | Soni et al. | 166/99 |
| 2012/0118576 | A1 * | 5/2012 | Telfer | 166/311 |

OTHER PUBLICATIONS

Drilling Practices Manual, Drilling Fluid Solids Removal, Preston Moore, 170, 173.

* cited by examiner

DEBRIS CHAMBER WITH HELICAL FLOW PATH FOR ENHANCED SUBTERRANEAN DEBRIS REMOVAL

FIELD OF THE INVENTION

The field of the invention is subterranean debris cleanup tools and more particularly the type of tools that direct debris with flow into the lower end of the tool and retain the debris in a collection volume around an inlet tube and most particularly also employ a swirling movement of the incoming debris laden stream to enhance separation in the tool.

BACKGROUND OF THE INVENTION

Milling operations at subterranean locations involve fluid circulation that is intended to remove cuttings to the surface. Some of these cuttings do not get transported to the surface and settle out on a wellbore support such as a packer or bridge plug that is below. In open hole situations the wellbore can collapse sending debris into the borehole. Over time sand and other debris can settle out on a borehole support and needs to be removed for access to the support or to allow further subterranean operations.

Wellbore cleanup tools have been used to remove such debris. Different styles have developed over time. In a traditional style the motive fluid goes through the center of the tool and out the bottom to fluidize the debris and send the debris laden stream around the outside of the tool where a diverter redirects flow through the tool body. A receptacle collects the debris as the clean fluid passes through a screen and is discharged above the diverter for the trip to the surface.

Another type of tool has a jet stream going downhole outside the tool to drive debris into the lower end of the tool where debris is collected and clean fluid that passes through a screen is returned to the surface outside the tool through ports located near the downhole oriented jet outlets. The jet outlets act as an eductor for pulling in debris laden flow into the lower end of the tool. Some examples of such tools are U.S. Pat. Nos. 6,176,311; 6,607,031; 7,779,901; 7,610,957; 7,472,745; 6,276,452; 5,123,489. Debris catchers with a circulation pattern that takes debris up on the outside of the tool body and routes it into the tool with a diverter are illustrated in U.S. Pat. Nos. 4,924,940; 6,189,617; 6,250,387 and 7,478,687.

The use of centrifugal force to separate components of different densities is illustrated in a product sold by Cavins of Houston, Tex. under the name Sandtrap Downhole Desander for use with electric submersible pump suction lines. U.S. Pat. No. 7,635,430 illustrates the use of a hydro-cyclone on a wellhead. Also relevant to the subterranean debris removal field is SPE 96440; P. Connel and D. B. Houghton; Removal of Debris from Deep Water Wellbore Using Vectored Annulus Cleaning System Reduces Problems and Saves Rig Time. Also relevant to the field of subterranean debris removal are U.S. Pat. Nos. 4,276,931 and 6,978,841.

Current designs of debris removal devices that take in the debris with fluid reverse circulating into the lower end of the tool housing have used a straight shot for the inlet tube coupled with a deflector at the top that can be a cone shape 10 as in FIG. 1 or a flat plate 12 as in FIG. 2. Arrow 14 represents the direction the solids need to go to be collected in the chamber 16 that is disposed around the inlet tube 18. One of the concerns of the FIGS. 1 and 2 designs is that a very long separation chamber that is between the cone 10 or the plate 12 and the outlet 20 is needed to separate the debris from the flowing fluid using gravity and the slowing for fluid velocity that occurs when the stream of debris laden fluid exits the inlet tube 18 and goes into the larger diameter of the housing 22 on the way to the outlet 20. After the outlet 20 there is a screen and what debris that does not fall out into the chamber 16 winds up putting a load on that screen above which impedes circulation and ability to pick up debris in the first place. Increasing the inlet velocity in an effort to entrain more debris into the tube 18 also winds up being counterproductive in the FIGS. 1 and 2 designs as the higher velocity after an exit from the tube 18 also causes higher turbulence and re-entrainment of the debris that would otherwise have been allowed to settle by gravity into the collection chamber 16. FIG. 9 illustrates the known VACS from Baker Hughes, a portion of which is shown in FIGS. 1 and 2. It also shows that the flow from exit 22 goes into a screen 23 and is then educted into a feed stream 25 from the surface. After the eductor exit 27 the flow splits with 29 going to the surface and 31 going to the bottom and into the inlet tube 18.

The present invention seeks to enhance the separation effect and do so in a smaller space and in a manner that can advantageously use higher velocities to enhance the separation. This is principally accomplished by inducing a swirl to the incoming debris laden fluid stream. The inlet tube can have spiral grooves or internal protrusions that impart the spiral pattern to the fluid stream so that the solids by centrifugal force are hurled to the outer periphery on the way to the outlet of the housing and the downstream screen. These and other aspects of the present invention will be more readily apparent to those skilled in the art from a review of the description of the preferred embodiment and the associated drawings while understanding that the full scope of the invention is to be determined from the appended claims.

SUMMARY OF THE INVENTION

A subterranean debris catcher swirls the incoming debris laden stream by putting grooves or spiral projections on the inside of the inlet pipe. In some embodiments the solids come out of openings in the side of the inlet pipe and in others the solids can exit near the top either directly into the enclosed solids holding volume as the liquid exits straight out or the solids can be discharged out the end of the inlet pipe into the bigger open space defined by the housing. In the latter case the inside housing wall can have a screen or vanes that slow down the solid particles as the fluid continues to a housing exit and eventually to an exit screen before being discharged to either go to the surface or recirculate back along the outside of the tool to the inlet pipe while picking up additional debris.

DETAILED DESCRIPTION OF THE PREFERRED EMBODIMENT

Figure 1:
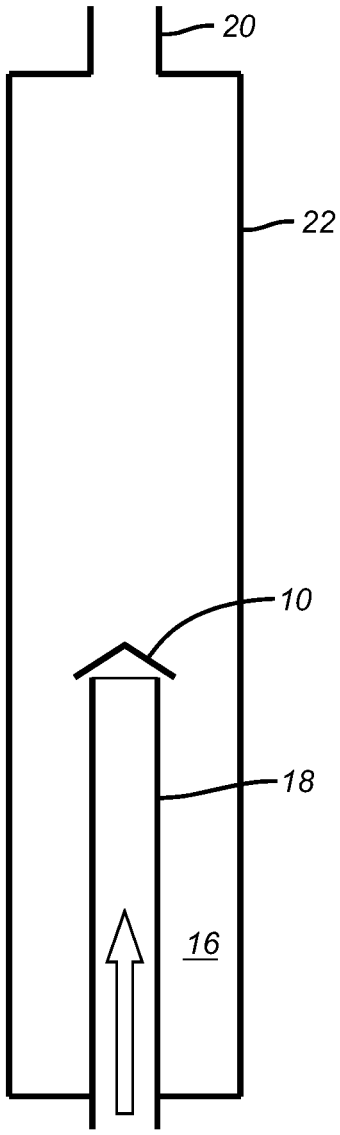
(PRIOR ART) FIG. 1
FIG. 1 is a prior art design of a debris removal tool taking in debris at a bottom location through an inlet tube with a cone-shaped cover on top.
Figure 2:
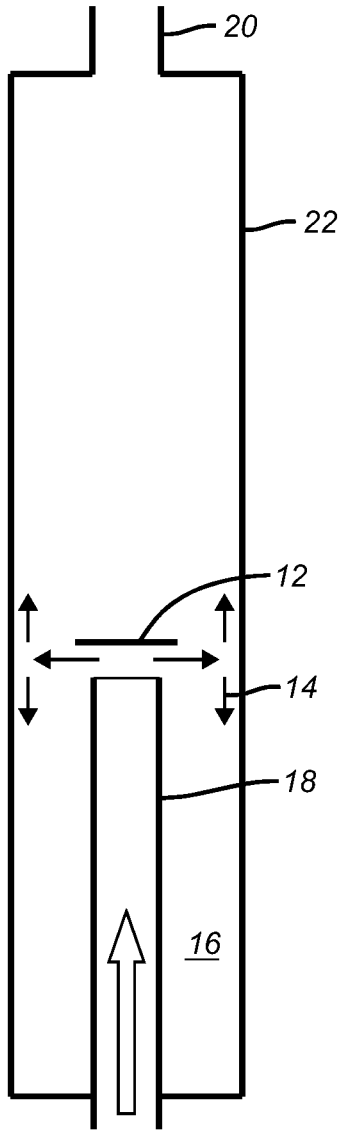
(PRIOR ART) FIG. 2
FIG. 2 is another prior art variation of FIG. 1 where a plate is located above the top outlet of the inlet tube.
Figure 3:
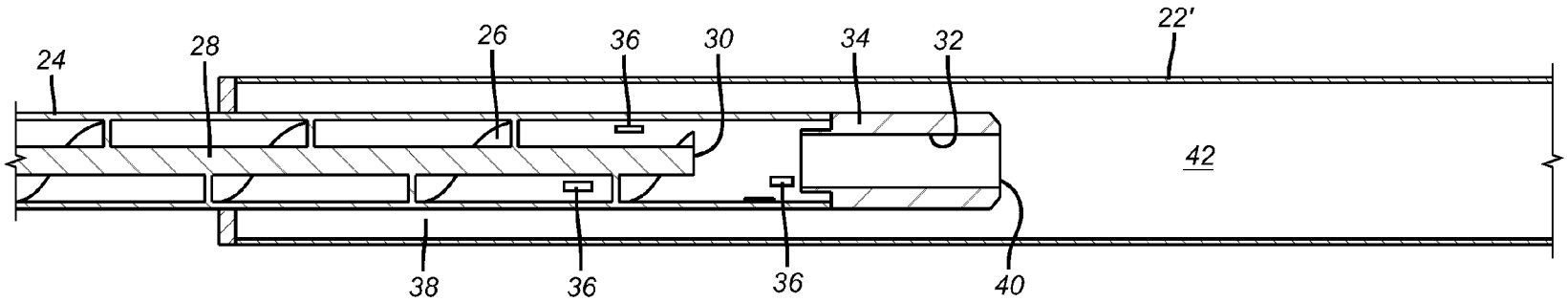
FIG. 3 shows an internal screw coupled with wall openings to let solids spun by the screw to exit radially into an open top annular debris collection space.

FIG. 3 shows an inlet tube 24 that is located in the same position as the inlet tube 18 of FIG. 2 with the differences being that there is no flat plate 12 in the FIG. 3 embodiment which otherwise employs the same housing 22' as in FIG. 2. Instead there is a helix 26 wrapped around a support shaft 28 that is preferably centered in the tube 24. Above the upper end 30 there is an axial gap in the tube 24 and then it continues as tube 32 through a cap 34. One or more radial openings 36 that lead to an annular space 38 that has an open top 40. Debris that exits through tube 32 then experiences a velocity decrease in zone 42 of the housing 22' and still has an opportunity to drop through the open top 40. Otherwise as with the scheme in the known designs the fluid stream with any entrained debris passes out the top of the housing 22' with there being a screen on the way out to retain the likely finer debris that made the trip out as high as the screen.

Figure 4:
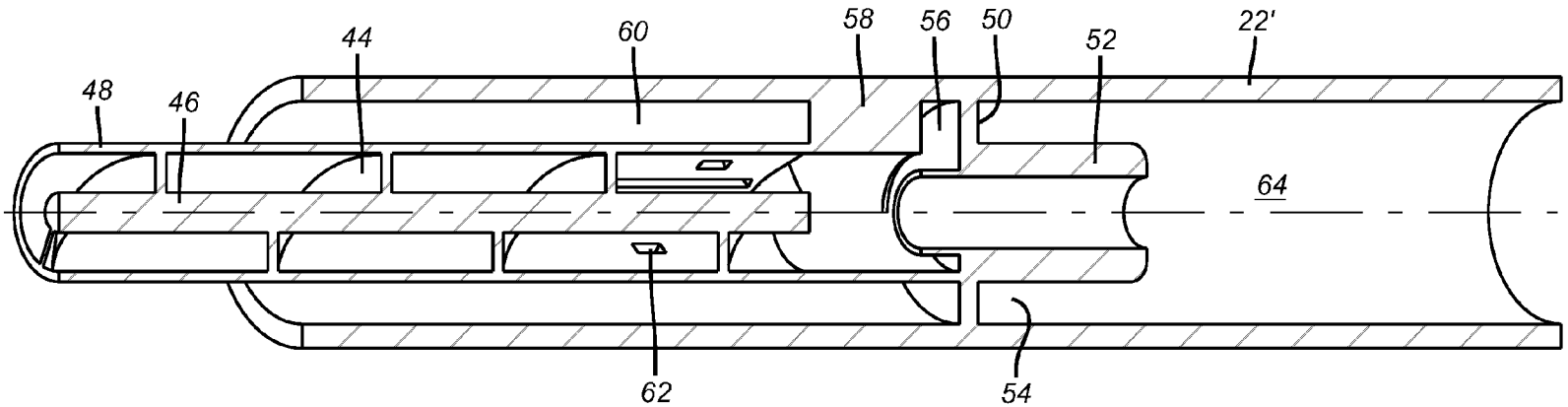
FIG. 4 shows an internal screw leading to a lateral debris exit to a closed top collection chamber with an internal baffle in the chamber.

FIG. 4 is somewhat different than FIG. 3. It still has a helical screw 44 on a support shaft 46 that is centrally located in the inlet tube 48. The inlet tube 48 has a top closure 50 with an extension tube 52 sticking up from the closure 50. An annular catch volume 54 is defined between the extension tube 52 and the housing 22'. A radial outlet 56 is disposed just below the top closure 50 for the swirling heavier debris to exit. As soon as such debris leaves the flowing liquid stream through outlet 56 it strikes a vertical baffle 58 designed to stop the swirling motion of the debris in the annular collection space 60 that has a closed bottom that is not shown. Optionally radial debris outlets 62 along the way up the tube 48 can also be used to remove debris by the swirling action induced by the screw 44. Any debris that escapes out the tube 52 still has an opportunity through the velocity reduction that occurs after entering the larger volume 64 to eventually settle into the catch volume 54.

Figure 5:
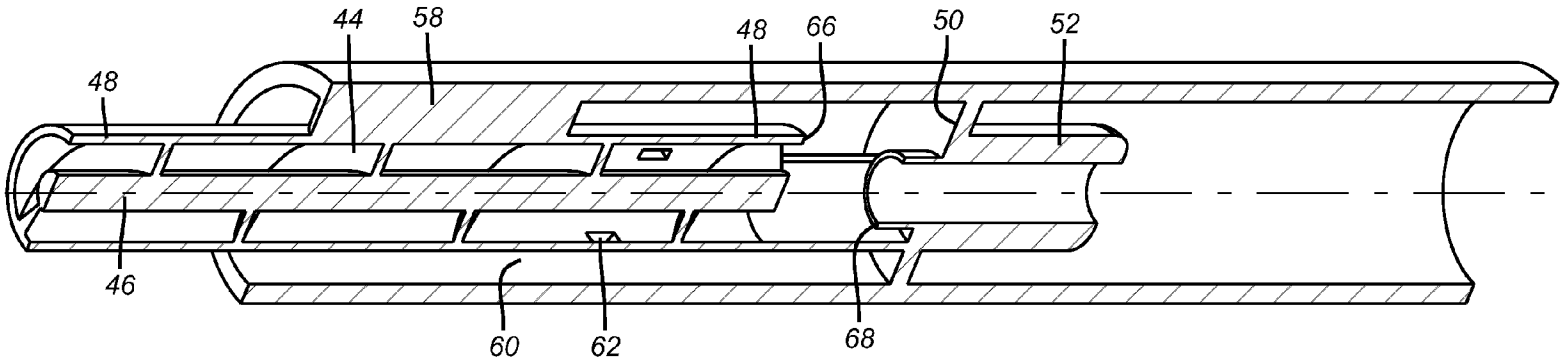
FIG. 5 shows a screw in the inlet tube leading to a gap before a closed top to the debris collection volume as the fluid exits straight out.

FIG. 5 is similar to FIG. 4 except that the formed radial exit 56 is not used and instead there is an axial gap between the top 66 inlet tube 48 and the lower end 68 of the extension tube 52. The baffle 58 is relocated lower than in FIG. 4 and optional radial debris outlets 62 can also be used. The bulk of the solids exit radially between ends 66 and 68 to enter the annular collection space 60.

Figure 6:
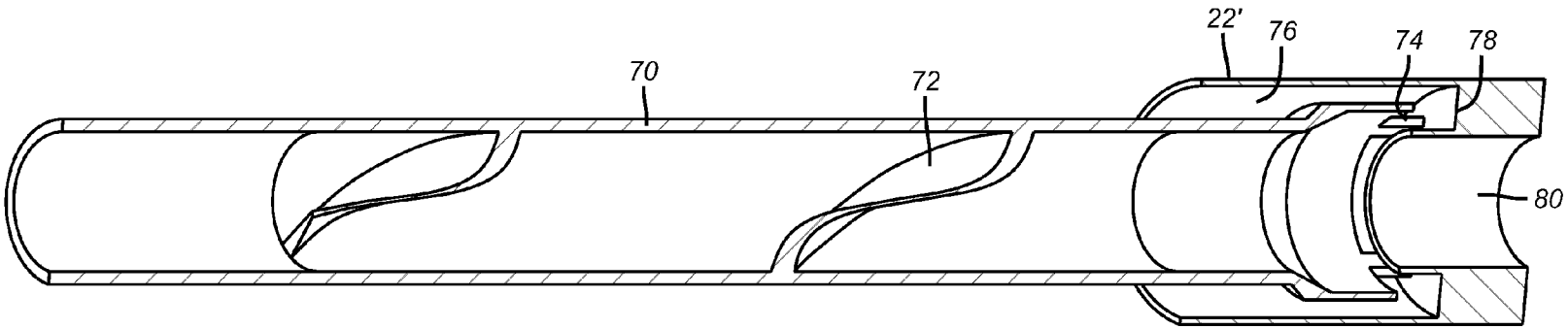
FIG. 6 shows a screw in the inlet pipe leading to a lateral exit to a closed top collection chamber.

FIG. 6 illustrates an inlet tube 70 akin to the inlet tube shown in FIG. 2 except that there is a screw 72 that in this embodiment has no central shaft. The swirling debris ideally exits the radial outlet 74 to enter the annular collection volume 76 that has a closed top 78. The fluid and some solids that have not made an exit through radial outlet 74 exit through the opening 80 and as before rise in the housing 22' to a screen. Note the lower end of the collection volume 76 is not shown.

Figure 7:
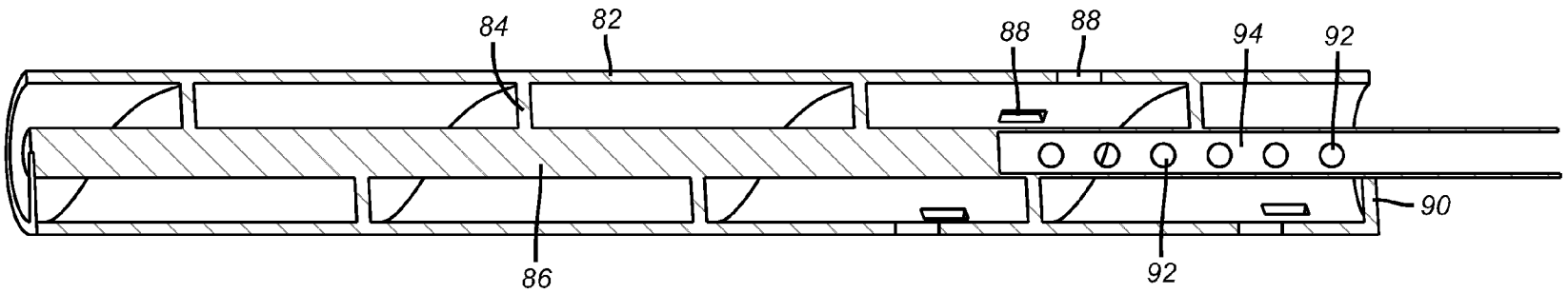
FIG. 7 shows a screw in the inlet tube with lateral slots where the fluid has to pass through openings in a central tube where the openings are below the closed top of the inlet tube.

FIG. 7 is similar to FIG. 3 except the surrounding housing to capture the debris is omitted to allow a focus on the inlet tube 82 that has a screw 84 on a shaft 86 with radial outlets 88 to let the debris be flung out radially into a surrounding collection volume that is not shown. The inlet tube 82 has a closed top 90 while the shaft 86 is mostly solid at its lower end but turns hollow near the top of the screw 84. There are a series of openings 92 into the hollow portion 94 to let the fluid and some debris that is still entrained to get out into the surrounding housing that is not shown in this view. From there the flow regime is the same as in FIG. 2 and above the baffle 12.

Figure 8:
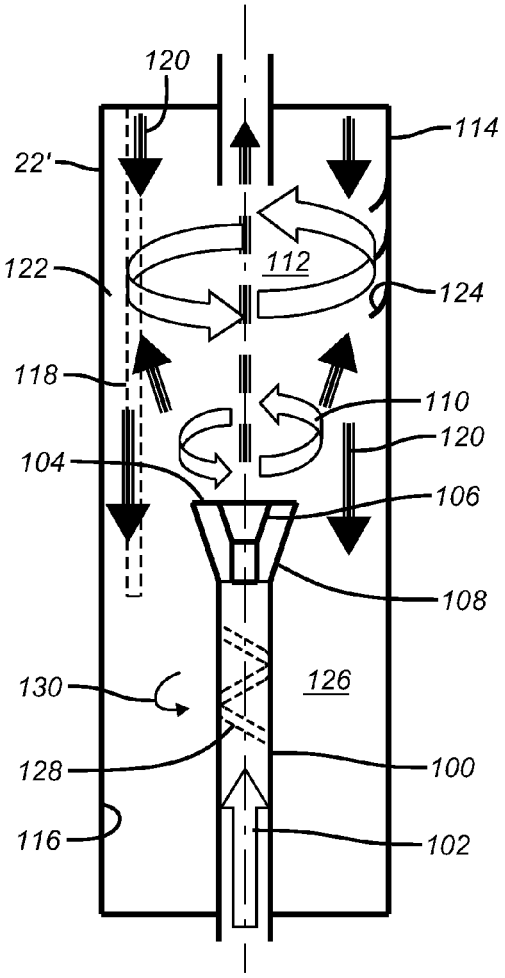
FIG. 8 illustrates an inlet tube schematically where the debris laden fluid exits near the top of the inlet tube and the solids encounter a screen or surface roughness to lose axial velocity to drop in and settle in a collection volume.
Figure 9:
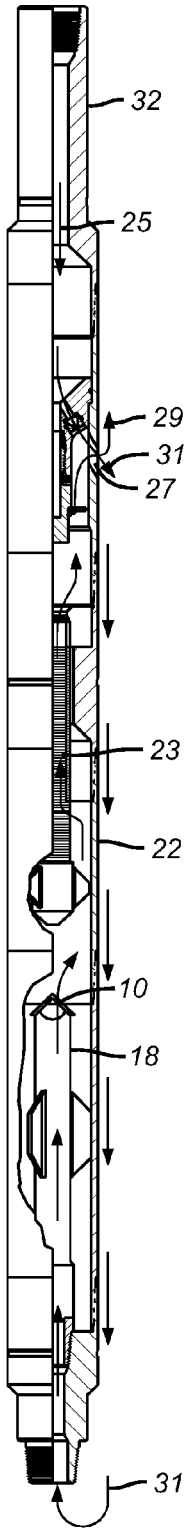
(PRIOR ART) FIG. 9
FIG. 9 is a section view of a prior art removal tool known as the VACS.

FIG. 8 is a somewhat different approach. The inlet tube 100 sees the entering debris stream represented by arrow 102 that has at the end a cap 104 with an angled deflector 106 just below to direct the fluid stream out through radial openings 108. In this embodiment, the entire fluid stream exits the openings 108 with all the debris and a swirling motion indicated by arrows 110 in region 112 of housing 114. The idea here is to minimize the height and thus the volume of the region 112 by the use of the swirling flow pattern 110 to make region 112 a separation zone between the debris and the motive fluid. An added option to the use of the swirling flow pattern 110 is to make the solids that are flung toward the wall 116 of the housing 114 is to use one or more devices on or near the inside wall that the solids contact and lose their axial momentum so that they can then drop vertically and outside the spiraling flow as indicated by arrows 120. One way to do this is to mount a tubular screen 118 (only half of which is shown to allow showing other options in the same FIG.). There is no meaningful fluid flow through the screen 118 into region 122 since there is no fluid outlet from region 122. An alternative to the tubular screen shape next to the wall 116 is a surface roughening of the wall itself. Another option is downwardly and inwardly oriented vanes 124 that also have the same purpose to slow the axial movement of the debris so that it can drop down into the collection volume 126 around the tube 100.

Other options to induce the swirling movement in the inlet tube of the various embodiments is to put a spiral groove or projection 128 shown in FIG. 8 as opposed to using a screw that takes the entire inside diameter as shown in for example FIG. 4. Another option is to mount the inlet tube on a bearing such as a sleeve to allow it to turn on its own axis as a reaction torque to the spin imparted to the incoming debris laden stream engaging the spiral pattern 128. This circular motion about its long axis for tube 100 for example is shown as arrow 130. As another alternative if there is power available the tube 100 can be power rotated with an electric motor or even a battery powered motor driven by a locally mounted battery. Rotating the tube such as 100 also can have an incidental benefit of enhancing the storage capacity of the debris retention volume 126 as the rotational movement will make the debris settle in a more compact manner to enhance the amount of debris that can be retained in the chamber 126.

The above description is illustrative of the preferred embodiment and many modifications may be made by those skilled in the art without departing from the invention whose scope is to be determined from the literal and equivalent scope of the claims below.

We claim:

1. A debris removal device for subterranean use operable to remove debris using pumped fluid flow, comprising:

a housing having a lower end inlet tube defining an annular debris collection volume with said housing and an upper end outlet;

said inlet tube configured to impart a spin to debris laden flow passing through said inlet tube for separation of debris from the fluid flowing to toward said outlet in said housing;

said debris collection volume has an impervious top;

entrance into said debris collection volume is below an upper end of said inlet tube and below a lower end of an outlet tube that extends through said top.

2. The device of claim 1, wherein:

said inlet tube has an elongated interior member that imparts a spin on the debris laden fluid.

3. The device of claim 2, wherein:

said elongated interior member comprises a helical form.

4. The device of claim 2, wherein:

said helical form is supported by a central shaft.

5. The device of claim 1, wherein:

said debris collection volume comprises at least one baffle oriented to reduce spiral debris movement in said debris collection volume.

6. A debris removal device for subterranean use operable to remove debris using pumped fluid flow, comprising:

a housing having a lower end inlet tube defining an annular debris collection volume with said housing and an upper end outlet;

said debris collection volume having a closed top;

said inlet tube comprising an elongated interior member;

entrance into said debris collection volume is below an upper end of said inlet tube and below a lower end of an outlet tube that extends through said closed top;

said elongated interior member comprises a helical projection or depression on an inside wall of said tube;

wherein said elongated interior member imparts a spin to the debris laden fluid.

7. A debris removal device for subterranean use operable to remove debris using pumped fluid flow, comprising:

a housing having a lower end inlet tube defining an annular debris collection volume with said housing and an upper end outlet;

said debris collection volume having a closed top;

said inlet tube comprising an elongated interior member;

entrance into said debris collection volume is below an upper end of said inlet tube and below a lower end of an outlet tube that extends through said closed top;

said tube having at least one opening in a curved wall of said tube for discharge of debris into or adjacent said debris collection volume;

wherein said elongated interior member imparts a spin to the debris laden fluid.

8. A debris removal device for subterranean use operable to remove debris using pumped fluid flow, comprising:

a housing having a lower end inlet tube defining an annular debris collection volume with said housing and an upper end outlet;

said inlet tube configured to impart a spin to debris laden flow passing through said inlet tube for separation of debris from the fluid flowing to toward said outlet in said housing said debris collection volume has a closed top;

entrance into said debris collection volume is below an upper end of said inlet tube and below a lower end of an outlet tube that extends through said closed top;

entrance into said debris collection volume is at said closed top.

9. The device of claim 8, wherein:

said inlet tube has an elongated interior member that imparts a spin on the debris laden fluid.

10. The device of claim 9, wherein:

said elongated interior member comprises a helical form.

11. The device of claim 9, wherein:

said helical form is supported by a central shaft.

12. The device of claim 9, wherein:

said elongated interior member comprises a helical projection or depression on an inside wall of said tube.

13. The device of claim 9, wherein:

said tube having at least one opening in a curved wall of said tube for discharge of debris into or adjacent said debris collection volume.

14. A debris removal device for subterranean use operable to remove debris using pumped fluid flow, comprising:

a housing having a lower end inlet tube defining an annular debris collection volume with said housing and an upper end outlet;

said inlet tube configured to impart a spin to debris laden flow passing through said inlet tube for separation of debris from the fluid flowing to toward said outlet in said housing said debris collection volume has a closed top;

entrance into said debris collection volume is below an upper end of said inlet tube and below a lower end of an outlet tube that extends through said closed top;

said outlet tube defining a second annular debris collection chamber on the other side of said closed top.

* * * * *